US008867941B2

(12) United States Patent
Takada

(10) Patent No.: US 8,867,941 B2
(45) Date of Patent: Oct. 21, 2014

(54) IMAGE HEATING APPARATUS CONFIGURED TO CONTROL BELT-MEMBER POSITION IN WIDTH DIRECTION THEREOF

(75) Inventor: Shigeaki Takada, Abiko (JP)

(73) Assignee: Canon Kabushiki Kaisha, Tokyo (JP)

( * ) Notice: Subject to any disclaimer, the term of this patent is extended or adjusted under 35 U.S.C. 154(b) by 274 days.

(21) Appl. No.: 13/427,301

(22) Filed: Mar. 22, 2012

(65) Prior Publication Data

US 2012/0251153 A1 Oct. 4, 2012

(30) Foreign Application Priority Data

Mar. 29, 2011 (JP) ..... 2011-071779

(51) Int. Cl.
*G03G 15/20* (2006.01)

(52) U.S. Cl.
CPC ..... *G03G 15/2053* (2013.01)
USPC ..... 399/67; 399/329

(58) Field of Classification Search
CPC ..... G03G 15/2053; G03G 2215/2009; G03G 2215/2016; G03G 2215/2025; G03G 2215/2032
USPC ..... 399/67, 328, 329
See application file for complete search history.

(56) References Cited

U.S. PATENT DOCUMENTS

| | | | | |
|---|---|---|---|---|
| 7,200,354 | B2 | 4/2007 | Nakamoto et al. | |
| 7,430,392 | B2 | 9/2008 | Ito et al. | |
| 7,430,393 | B2 * | 9/2008 | Kuroki et al. | 399/329 |
| 7,457,576 | B2 | 11/2008 | Takada et al. | |
| 7,466,950 | B2 | 12/2008 | Matsuura et al. | |
| 7,596,348 | B2 | 9/2009 | Nakamoto et al. | |
| 7,702,270 | B2 | 4/2010 | Yoshida | |
| 7,844,208 | B2 | 11/2010 | Hayashi et al. | |
| 8,116,671 | B2 * | 2/2012 | Li et al. | 399/329 |
| 8,311,470 | B2 * | 11/2012 | Okamoto | 399/329 |
| 2007/0223975 | A1 | 9/2007 | Yoshida | |
| 2008/0038027 | A1 | 2/2008 | Ito et al. | |
| 2008/0226325 | A1 | 9/2008 | Yamanaka et al. | |
| 2011/0135352 | A1 | 6/2011 | Takada | |
| 2012/0003346 | A1 | 1/2012 | Chigono et al. | |

FOREIGN PATENT DOCUMENTS

| | | | |
|---|---|---|---|
| CN | 101042564 | A | 9/2007 |
| CN | 101093379 | A | 12/2007 |
| JP | 2008-40363 | A | 2/2008 |
| JP | 2010-107659 | A | 5/2010 |

OTHER PUBLICATIONS

Chinese Office Action dated Aug. 5, 2014, issued in counterpart Chinese Application No. 201210088351.3, and English-language translation thereof.

* cited by examiner

*Primary Examiner* — William J Royer
(74) *Attorney, Agent, or Firm* — Fitzpatrick, Cella, Harper & Scinto

(57) ABSTRACT

An image heating apparatus includes: a belt for heating in a nip an image formed on a recording material; a rotatable steering member for stretching the belt and for controlling the position of the belt with respect to a widthwise direction by inclination; a slidable member provided so as to be movable toward and away from a surface of the belt; a contact and separation portion for moving the slidable member toward and away from the belt; an execution portion capable of executing an operation in a sliding mode in which the slidable member contacts the belt and is slid on the surface of the belt; and a controller for controlling a maximum inclination angle of the rotatable steering member during execution of the operation in the sliding mode so that the maximum inclination angle is set at a value smaller than that during image formation.

10 Claims, 7 Drawing Sheets

IMAGE HEATING APPARATUS CONFIGURED TO CONTROL BELT-MEMBER POSITION IN WIDTH DIRECTION THEREOF

FIELD OF THE INVENTION AND RELATED ART

The present invention relates to an image heating apparatus for heating an image by bringing a belt member, which is lateral shift-controlled by inclining a slidable member, into contact with an image surface of a recording material. Specifically, the present invention relates to lateral shift control of the belt member in an operation in a sliding mode for adjusting a surface state of the belt member by causing the slidable member to contact the belt member.

An image forming apparatus in which a fixing device for fixing a toner image on the recording material by heat-pressing the recording material on which the toner image is transferred is mounted has been widely used. Further, an image surface treating device for heating and pressing the image surface of the recording material, on which a partly or completely fixed toner image is carried to adjust the image surface so as to have a predetermined surface state has also been put into practical use alone or in the form of being mounted in the image heating apparatus. The image heating apparatus includes the fixing device and the image surface treating device.

The image heating apparatus for heating the image by causing the belt member to contact the image surface of the recording material has been put into practical use. In the image heating apparatus using the belt member, normally, in order to prevent the recording material from deviating from a predetermined lateral shift range, the belt member is subjected to lateral shift control by inclining (tilting) a rotatable steering member, depending on a lateral shift position of the belt member (Japanese Laid-Open Patent Application (JP-A) 2010-107659).

In the image heating apparatus using the belt member, with the occurrence of heating operations of the recording material, an abrasion mark or unevenness (projection and recess) is eventually generated at a position where the surface of the belt member contacts an edge of the recording material and is accumulated, so that there is a possibility that uneven glossiness occurs at the heated image surface. For example, when a fixing process of the recording material with a small sheet passing width is performed, eventually, a band-like abrasion mark is accumulated at a position on the belt member where widthwise end portions of the recording material slide on the belt member. Thereafter, when the fixing of the recording material with a large sheet passing width is effected, the accumulated abrasion mark is pressure-transferred onto the image surface, so that a band-like region in which the glossiness is lowered is generated on the image surface.

In JP-A 2010-107659, by shifting a lateral shift target position of steering control, the abrasion mark is dispersed into a wide range of the belt member, so that the band-like region, in which the glossiness is lowered, formed on the image surface is made inconspicuous.

In order to further improve an image quality of an output image, not only the abrasion mark by the end portions of the recording material is dispersed by the steering control, but also there is a need to take a new countermeasure. As an example of the countermeasure, a constitution can be employed in which a region where the range of the lateral shift control is enlarged to disperse the abrasion mark is increased, but when this constitution is employed, there is a need to ensure a movement width of the belt. and therefore the size of the fixing device is increased.

For that reason, as described in JP-A 2008-40363, execution of an operation in a refreshing mode during predetermined non-image formation has been proposed. In the case of the belt member, the belt member is wound about a grindstone adjust to ensure a wide contact area, and therefore it was discovered that effective adjustment of a surface state can be effected in a shorter time than that in the case of a fixing roller.

However, when the operation in the refreshing mode is executed in a short time, an inclination (tilting) state of a rotatable steering member during the operation is substantially fixed, and therefore, it was found that a difference in sliding state is generated at longitudinal end portions of a slidable member, depending on the inclination state of the rotatable steering member during the operation. As a result of the generation of a difference in contact pressure or contact length with respect to the belt member at the longitudinal end portions of a rotatable member of the slidable member by the inclination state of the rotatable steering member, it was found that there arose a difference in the adjusted surface state to impair the uniformity of glossiness of subsequent fixing images.

SUMMARY OF THE INVENTION

A principal object of the present invention is to provide an image heating apparatus capable of reducing the variation in belt member surface state adjusted by an operation in a sliding mode.

According to an aspect of the present invention, there is provided an image heating apparatus comprising: a belt member for heating in a nip an image formed on a recording material; a rotatable steering member for stretching the belt member and for controlling a position of the belt member with respect to a widthwise direction by inclination; a slidable member provided so as to be movable toward and away from a surface of the belt member; contact-and-separation means for moving the slidable member toward and away from the belt member; an execution portion capable of executing an operation in a sliding mode in which the slidable member is contacted to the belt member and is slid on the surface of the belt member; and control means for controlling a maximum inclination angle of the rotatable steering member during execution of the operation in the sliding mode so that the maximum inclination angle is set at a value smaller than that during image formation.

These and other objects, features and advantages of the present invention will become more apparent upon a consideration of the following description of the preferred embodiments of the present invention taken in conjunction with the accompanying drawings.

DESCRIPTION OF THE PREFERRED EMBODIMENTS

Hereinbelow, embodiments of the present invention will be described in detail with reference to the drawings.

In the following embodiments, only a principal portion concerning formation/transfer of the toner image will be described, but the present invention can be carried out in image forming apparatuses with various uses including printers, various printing machines, copying machines, facsimile machines, multi-function machines, and the like by adding necessary equipment, options, or casing structures.

Image Forming Apparatus

Figure 1:
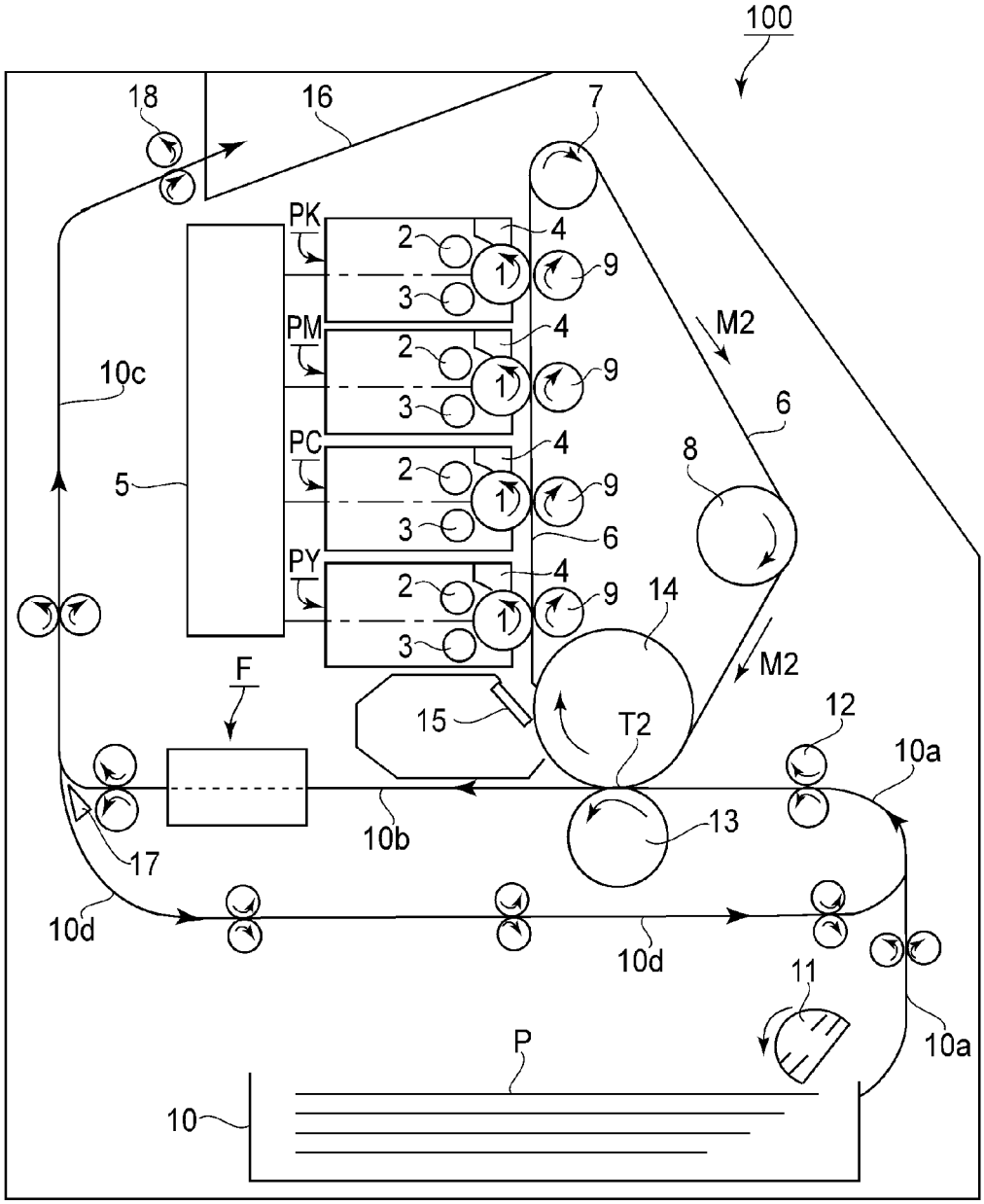
FIG. 1 is an illustration of a structure of an image forming apparatus.

FIG. 1 is an illustration of structure of an image forming apparatus. As shown in FIG. 1, an image forming apparatus 100 in this embodiment is a tandem-type full-color printer of an intermediary transfer type in which image forming portions PY, PM, PC and PK for yellow, magenta, cyan and black, respectively, are arranged along an intermediary transfer belt 6.

In the image forming portion PY, a yellow toner image is formed on a photosensitive drum 1(Y) and then is transferred onto the intermediary transfer belt 6. In the image forming portion PM, a magenta toner image is formed on a photosensitive drum 1(M) and is transferred superposedly onto the yellow toner image on the intermediary transfer belt 6. In the image forming portions PC and PK, a cyan toner image and a black toner image are formed on photosensitive drums 1(C) and 1(K), respectively, and are transferred superposedly onto the intermediary transfer belt 6.

The intermediary transfer belt 6 is extended around and stretched by a driving roller 7, a secondary transfer opposite roller 14 and a tension roller 8 and is rotationally driven in an arrow M2 direction by the driving roller 7. A recording material P is pulled out from a recording material cassette 10 one by one by a pick-up roller 11 and is conveyed on path 10*a* to wait between registration rollers 12.

The registration rollers 12 send the recording material P to a secondary transfer portion T2 between roller 14 and a roller 13, while timing the recording material P movement to the toner images on the intermediary transfer belt 6.

The recording material P on which the four color toner images are secondary-transferred from the intermediary transfer belt 6 is conveyed along a path 10*b* into a fixing device F, and after being heated and pressed by the fixing device F to fix the toner images thereon, is discharged onto an external tray 16 by discharging rollers 18. Transfer residual toner which passes through the secondary transfer portion T2 and remains on the intermediary transfer belt 6 is removed by a belt cleaning device 15.

On the other hand, in the case where the toner images are formed on both surfaces of the recording material P, the recording material P, on which the toner images are fixed on one surface thereof by the fixing device F, is guided upward by a flapper 17. The recording material P is turned upside down by being switchback-conveyed along a conveyance path 10*c* and thereafter is conveyed on a both-side (recording material) conveyance path 10*d* to wait between the registration rollers 12. Then, the toner images are formed also on the other surface of the recording material P at the secondary transfer portion T2 and are, after being fixed by the fixing device F, discharged onto the external tray 16.

The image forming portions PY, PM, PC and PK have the substantially same constitution except that the colors of toners of yellow, cyan, magenta and black used in developing devices 3(Y), 3(M), 3(C) and 3(K) are different from each other. In the following description, the yellow image forming portion PY will be described and other image forming portions PM, PC and PK will be omitted from redundant description.

The image forming station PY includes the photosensitive drum 1 around which a charging roller 2, an exposure device 5, the developing device 3, a transfer roller 9, and a drum cleaning device 4 are disposed.

The charging roller 2 electrically charges the surface of the photosensitive drum 1 to a uniform potential. The exposure device 5 writes (forms) an electrostatic image for an image on the photosensitive drum 1 by scanning with a laser beam. The developing device 3 develops the electrostatic image to form the toner image on the photosensitive drum 1.

The transfer roller 9 is supplied with a voltage, so that the toner image on the photosensitive drum 1 is primary-transferred onto the intermediary transfer belt 6.

Fixing Device

Figure 2:
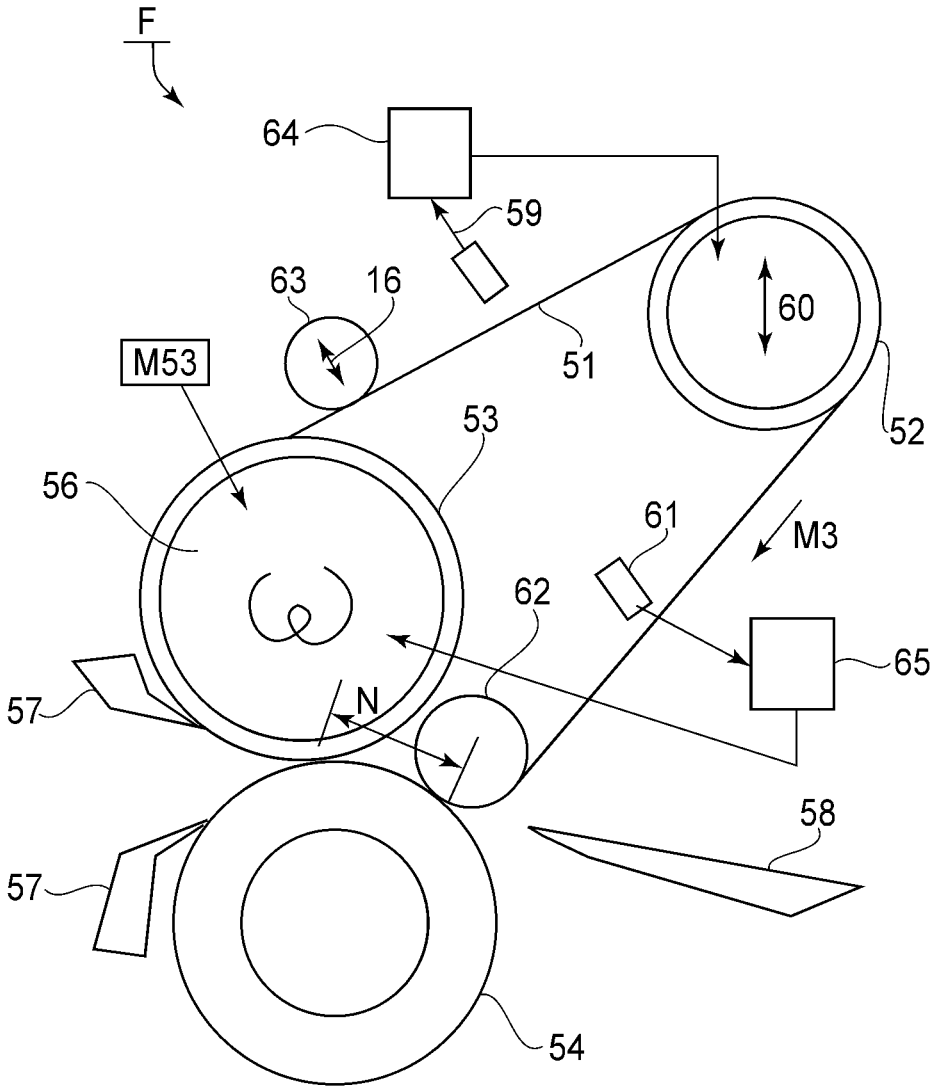
FIG. 2 is an illustration of a structure of a fixing device.

FIG. 2 is an illustration of a structure of the fixing device F. As shown in FIG. 1, the recording material P on which the toner images are secondary-transferred is curative-separated from the intermediary transfer belt 6 and passes through the conveyance path 10*d*, thus being introduced into the fixing device F which is an example of the image heating apparatus. The fixing device F fuses and flattens the toner images during nip-conveyance under heat and pressure of the recording material P on which the toner images are secondary-transferred, thus fixing a full-color image on the recording material P.

FIG. 2 is an illustration of a structure of the fixing device F. As shown in FIG. 1, the recording material P on which the toner images are secondary-transferred is curative-separated from the intermediary transfer belt 6 and passes through the conveyance path 10*d*, thus being introduced into the fixing device F which is an example of the image heating apparatus. The fixing device F fuses and flattens the toner images during nip-conveyance under heat and pressure of the recording material P on which the toner images are secondary-transferred, thus fixing a full-color image on the recording material P.

As shown in FIG. 2, the fixing device F forms a fixing nip N of the recording material P between a fixing belt (belt member) 51 and a pressing roller 54. The fixing belt 51 is extended around and stretched by a fixing roller 53, a steering roller (steering member) 52 and a pushing roller 62. The pressing roller 54 is press-contacted to the fixing belt 51 against the fixing roller 53 to nip the fixing belt 51 together with the fixing roller 53.

The fixing belt 51 employs, as a base layer, a heat-resistant resin material such as polyimide or a metal belt of SUS, Ni or the like. The thickness of the base layer is about 20-100 μm. On the base layer, an elastic layer of a heat-resistant silicone rubber is laminated in a thickness of about 20-500 μm. On the surface of the elastic layer, a PFA layer as a parting layer is laminated in a thickness of 30-100 μm.

The fixing roller 53 is constituted by a roller which includes a cylindrical aluminum metal core and 5-10 μm thick elastic layer formed of a sponge or the heat-resistant silicone rubber on the metal core and which is 50 mm in outer diameter, and is driven by a driving motor M53 to rotate the fixing belt 51 in an arrow M3 direction.

The pressing roller 54 is constituted, similarly as in the fixing roller 53, by a roller which includes the cylindrical aluminum metal core and a 2-10 μm thick elastic layer formed of the sponge or a heat-resistant silicone rubber on the metal core and which is 50 mm in outer diameter. As an outermost layer of the pressing roller 54, a silicone rubber parting layer, which has a good parting property with the toner and a good affinity with oil, is formed.

At the end portions of the pressing roller 54, the pressing roller 54 is urged toward the fixing roller 53 with a pressure load of 500 N to 1000 N at a total pressure. As a result, the elastic layers of the fixing roller 53 and the pressing roller 54 are deformed, so that the curvature-separation performance of the recording material P at an exit side of the fixing nip N is enhanced.

The pushing roller 62 is formed with an aluminum cylinder of 50 mm in outer diameter and 3 mm in thickness, and is disposed upstream of the fixing nip N, and pushes the fixing belt 51 against the pressing roller 54 to enlarge the fixing nip N. The pushing roller 62 pushes down the fixing belt 51, whereby the fixing belt 51 ranging from the pushing roller 62 to the fixing roller 53 is continuously contacted to the pressing roller 54 to form a long fixing nip N. The fixing nip N is formed by the fixing belt 51 and a plurality of the rollers and therefore a long heating area can be ensured with respect to a conveyance direction, so that a good fixing performance can be obtained without increasing the size of the fixing device F and while keeping the fixing belt 51 at a relatively low temperature.

Each of the recording material separation claws 57 is disposed in contact with or close to the surface of the fixing belt 51 or the pressing roller 54 at the exit side of the fixing nip N. A conveyance guide 58 conveys the recording material P to the fixing nip N.

A heating source 56 is a heat generating element constituted by a halogen lamp heater and infrared-heats the inner surface of the fixing roller 53. A temperature detecting element (thermistor) 61 detects the temperature of the fixing belt 51 upstream of the fixing nip N at an upstream position with respect to the fixing nip N. A temperature control device 65 discriminates the temperature of the surface of the fixing belt 51 on the basis of an output signal of the temperature detecting element 61 and controls electric power supplied to the heating source 56 on the basis of a discrimination result.

Incidentally, in a belt type fixing device, when a direction perpendicular to a movement direction of the fixing belt is taken as a belt widthwise direction, there is a need to control a widthwise position of the fixing belt during the movement. A representative method of controlling the widthwise position of the fixing belt is such that a regulating guide plate (collar) is provided at each of ends of a rotatable supporting member to position the fixing belt at a predetermined widthwise direction.

The type of control method using the regulating guide plate has the advantage that the manufacture of the fixing device can be simple and inexpensive, but the belt end portions contact the regulating guide plate and therefore it is difficult to extend the life of the fixing belt due to the problem that the end portions of the fixing belt can become broken or cause buckling of the belt. Particularly, in the case where the rotational speed of the fixing belt is fast, the lateral shift speed of the fixing belt correspondingly becomes fast, so that a force exerted on the belt end portions and the regulating guide plates becomes large and thus it becomes more difficult to realize the extension of the life of the belt.

For this reason, the fixing device F employs an active steering type mechanism in which the steering roller 52 is inclined to dynamically control the widthwise position of the fixing belt 51 during the movement.

Steering Mechanism

Figure 3:
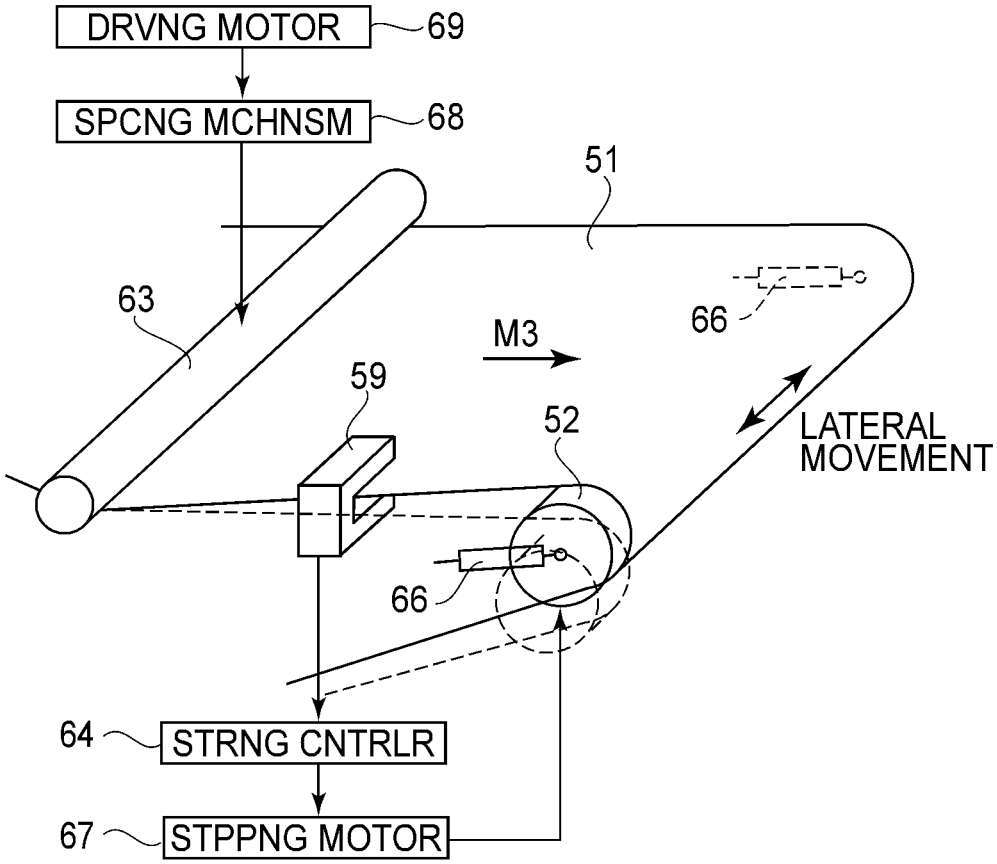
FIG. 3 is an illustration of an operation of a steering roller.

FIG. 3 is an illustration of an operation of the steering roller 52. In this embodiment, the active steering type mechanism is employed in which one (rotatable steering member) of the rotatable supporting members for extending and stretching the belt member is inclined (tilted) to control the lateral shift position of the belt member. In the case of the active steering type mechanism, the force is not exerted on the edges of the belt member and therefore the problem that the end portions of the belt member causes breakage or buckling does not occur, so that the extension of the life of the fixing device becomes possible.

As shown in FIG. 3, the method of controlling the lateral shift position of the fixing belt 51 by inclination of the steering roller 52 does not cause the problem of the breakage or buckling of the edges of the fixing belt 51 since the force is not exerted on the edges of the fixing belt 51, so that it becomes possible to extend the life of the fixing device F.

The steering roller 52 is formed of an aluminum cylinder of 50 mm in outer diameter and 3 mm in thickness and is urged outward at its end portions by an urging mechanism 66, thus applying a proper tension to the fixing belt 51. The steering roller 52 is constituted so that it is inclined as a whole by displacement thereof in a direction of an arrow 60 at its front side with a supporting point at its rear side. A belt lateral shift position sensor 59 detects the position of a widthwise end portion of the fixing belt 51 by using a flag-type sensor or a CCD line sensor.

A steering controller 64 actuates a stepping motor 67, depending on the lateral shift position of the fixing belt 51 detected by the belt lateral shift position sensor 59, thus controlling the inclination angle of the steering roller 52. The steering controller 64 controls the lateral shift position of the fixing belt 51 by adjusting the inclination angle of the steering roller 52 on the basis of an output of the belt lateral shift position sensor 59. A home position of the steering roller 52 is a center of an inclinable range and when the steering roller 52 is located at the home position, the steering roller 52, the fixing roller 53 and the pushing roller 62 are provided so that their shafts are parallel to each other.

When the front side of the steering roller 52 is moved upward, a winding state of the fixing belt 51 about the steering roller 52 is twisted so that a winding end position of the fixing belt 51 about the steering roller 52 is located toward the rear side more than a winding start position of the fixing belt 51 about the steering roller 52. As a result, with rotation of the steering roller 52 in an arrow M3 direction, the fixing belt 51 is moved toward the rear side.

On the other hand, when the front side of the steering roller 52 is moved downward, the winding state of the fixing belt 51 is twisted so that the winding end position of the fixing belt 51 about the steering roller 52 is located toward the front side more than the winding start position of the fixing belt 51 about the steering roller 52. As a result, with rotation of the steering roller 52 in an arrow M3 direction, the fixing belt 51 is moved toward the front side.

Incidentally, the active steering type mechanism includes a both-end reciprocation type mechanism in which the belt member is simply reciprocated between predetermined maximum lateral shift positions and a center convergence type mechanism in which the rotational position of the belt member is conveyed to a predetermined center position.

In the both-end reciprocation type mechanism, the rotatable steering member is largely inclined every time when the belt member reaches the maximum lateral shift position with respect to the widthwise direction to reverse the lateral shift direction, so that the belt member is subjected to unlimited reciprocating motion in the widthwise direction. In the both-end reciprocation type mechanism, the belt member is largely moved in the longitudinal direction of the rotatable steering member to continuously change a relative position between the edge of the recording material and the belt member and therefore the abrasion work at the recording material edge is dispersed in the belt member widthwise direction, so that the both-end reciprocation type is advantageous in durability of the belt member. On the other hand, when a disturbance acts on the belt member in a state in which the belt member is located in the neighborhood of the maximum lateral shift position, there arises a possibility that the belt member exceeds the maximum lateral shift position to be disengaged. In order to prevent the disengagement, when the maximum lateral shift position is detected, there is a need to effect steering largely with respect to an opposite direction and therefore the inclination angle of the rotatable steering member is set at a large value, so that the stretching surface of the belt member is largely inclined.

In the center convergence type mechanism, a lateral shift amount of the belt member is obtained in real time by continuously detecting the lateral shift position of the belt member. Then, as the belt member approaches the widthwise center, the inclination angle of the rotatable steering member is made small, so that the lateral shift movement of the belt member is converged at the center. The inclination angle of the rotatable steering member is made larger with a distance of the belt member from the widthwise center, so that the lateral shift position of the belt member is guided to the widthwise center. In the center convergence type mechanism, the belt member continuously remains at the widthwise center of the recording material edges, which continuously slide on the belt member at a specific widthwise position, so that the life of the belt member is shortened. However, when the disturbance acts on the belt member, the possibility that the belt member exceeds the maximum lateral shift position and thus is disengaged from the rotatable steering member is low.

Refreshing Roller

In the fixing device in which the belt member is contacted to the image surface of the recording material, by continuous sheet passing of thick paper or the same size paper, there is the problem of the generation of paper edge marks on the belt member surface such that an abrasion mark is generated at the surface of the belt member corresponding to a leading end of the recording material or widthwise edges of the recording material (paper edges) to cause uneven glossiness at the surface of the image.

On the other hand, in the fixing device F, an operation in a sliding mode is executed during non-image formation, and thus the slidable member is contacted to the belt member, so that the slidable member slides on the surface contacting the unfixed image to make uniform the surface state to a predetermined state. By performing the operation in the sliding mode, the surface property of the belt member is maintained, so that image deterioration is suppressed, and thus it becomes possible to improve the durability of the belt member.

As shown in FIG. 2, the fixing belt 51, which is an example of the belt member, contacts the image surface of the recording material P. The steering roller 52, which is an example of the rotatable steering member, is inclined to effect the lateral shift control of the fixing belt 51. A refreshing roller 63, which is the slidable member, is provided so as to be movable toward and away from the stretching surface of the fixing belt 51, and is spaced from the fixing belt 51 when the image is heated during the image formation. However, when the operation in the refreshing mode is executed during predetermined non-image formation, the refreshing roller 63 is contacted to the fixing belt 51 to adjust the surface state of the fixing belt 51.

The refreshing roller 63 is formed by adhesively bonding abrasive grains as an abrasive agent in a dense state onto a metal core of SUS and of 12 mm in outer diameter via an adhesive layer. As the abrasive agent, it is possible to use aluminum oxide, aluminum oxide hydroxide, silicon oxide, cerium oxide, titanium oxide, zirconia, lithium silicate, silicon nitride, silicon carbide, iron oxide, chromium oxide, antimony oxide, diamond, and the like. It is also possible to use abrasive grains of any of mixtures of these materials which are subjected to adhesive bonding treatment via the adhesive layer. In this embodiment, as the abrasive agent, alumina (aluminum oxide)-based material (which is also called "alundum" or "molundam") was used. The alumina-based material is the abrasive grain that is most widely used and has a sufficiently high hardness compared with the fixing belt 51 and has an acute-angle shape. Therefore, the alumina-based material is excellent in machineability and is suitable as the abrasive agent.

The refreshing roller 63 is movable in a direction of an arrow 16 and is capable of being pressed against the fixing belt 51 with a predetermined penetration (entering) amount and is movable toward and away from the fixing belt 51 by a spacing mechanism (contact-and-separation mechanism) 68. When the refreshing roller 63 is pressed against the fixing belt 51 with the predetermined penetration amount, a sliding nip is formed between the refreshing roller 63 and the fixing belt 51.

The refreshing roller 63 is driven by a driving motor 69. The rotational direction may be either of the same direction and an opposite direction with respect to the surface movement direction of the fixing belt 51, but it is desirable that a difference in peripheral speed is provided between the surface speeds of the fixing belt 51 and the refreshing roller 63. The refreshing roller 63 is contacted to the fixing belt 51 with the peripheral speed difference to provide fine abrasion marks on the surface of the fixing belt 51 in the entire region (sheet-passing region, non-sheet-passing region and edge portions) with respect to the longitudinal direction of the refreshing roller 63, so that the difference of the surface state between projections and recesses is eliminated. As a result, the abrasive marks provided on the surface of the fixing belt 51 are superposed with the fine abrasive marks, so that the influence thereof on the output image on the recording material can be made invisible (unrecognizable).

The operation in the refreshing mode is performed when the abrasive mark is provided at the surface of the fixing belt 51 such as after the abrasive mark is provided at the leading end of the paper or at the paper edge portions by passing the thick paper through the fixing nip or after the same size recording material is subjected to the continuous image formation on not less than a predetermined number of sheets. The operation in the refreshing mode may also be performed before sheet passing on coated paper on which the influence of the abrasion mark on the surface of the fixing belt 51 is liable to appear on the image or by a direct selecting operation of a user who discriminates the state of the output image.

Incidentally, in the case where the operation in the refreshing mode is performed with respect to the belt member of the active steering type, when the belt for extending and stretching the belt member is inclined, the relative angle between the belt member and the slidable member is changed. As a result, in some cases, it becomes difficult to uniformize the contact area between the belt member and the slidable member with respect to the belt member widthwise direction.

For example, in the case where the rear side of the steering roller 52 is fixed and the front side of the steering roller 52 is vertically moved to thereby incline the steering roller 52, in order to move the fixing belt 51 toward the front side, the front side of the steering roller 52 is moved downward. At this time, at the rear side of the fixing belt 51, vertical movement is fixed and therefore there is substantially no change in locus of the fixing belt 51. For this reason, there is substantially no change in contact area between the fixing belt 51 and the refreshing roller 63. However, at the front side of the fixing belt 51, the locus of the fixing belt 51 is moved in a direction in which it is moved away from the refreshing roller 63, and therefore the contact area between the fixing belt 51 and the refreshing roller 63 is decreased.

On the other hand, in order to move the fixing belt 51 toward the rear side, the front side of the steering roller 52 is moved upward. At this time, at the rear side of the fixing belt 51, vertical movement is fixed and therefore there is substantially no change in locus of the fixing belt 51. For this reason, there is substantially no change in the contact area between the fixing belt 51 and the refreshing roller 63. However, at the widthwise front side of the fixing belt 51, the locus of the fixing belt 51 is moved in a direction in which it approaches the refreshing roller 63, and therefore the contact area between the fixing belt 51 and the refreshing roller 63 is increased.

By moving the steering roller 52, at the rear side of the fixing belt 51, the contact area between the fixing belt 51 and the refreshing roller 63 is not substantially changed, but at the front side of the fixing belt 51, the contact area between the fixing belt 51 and the refreshing roller 63 is increased and decreased. Therefore, when the lateral shift control is effected during the sliding of the refreshing roller 63 on the fixing belt 51, the difference in contact area between the fixing belt 51 and the refreshing roller 63 occurs between the front side and the rear side. As a result, the surface state of the fixing belt 51 after the operation in the refreshing mode is different between the front side and the rear side, so that when a solid image is formed on, e.g., coated paper, a difference in glossiness or color tint remarkably appears.

Therefore, in the following embodiments, in the operation in the slidable member, the inclination angle of the steering roller 52 is made smaller than that during the image formation, so that the surface state of the fixing belt 51 after the operation in the refreshing mode is prevented from differing between the front side and the rear side.

Embodiment 1

Figure 4:
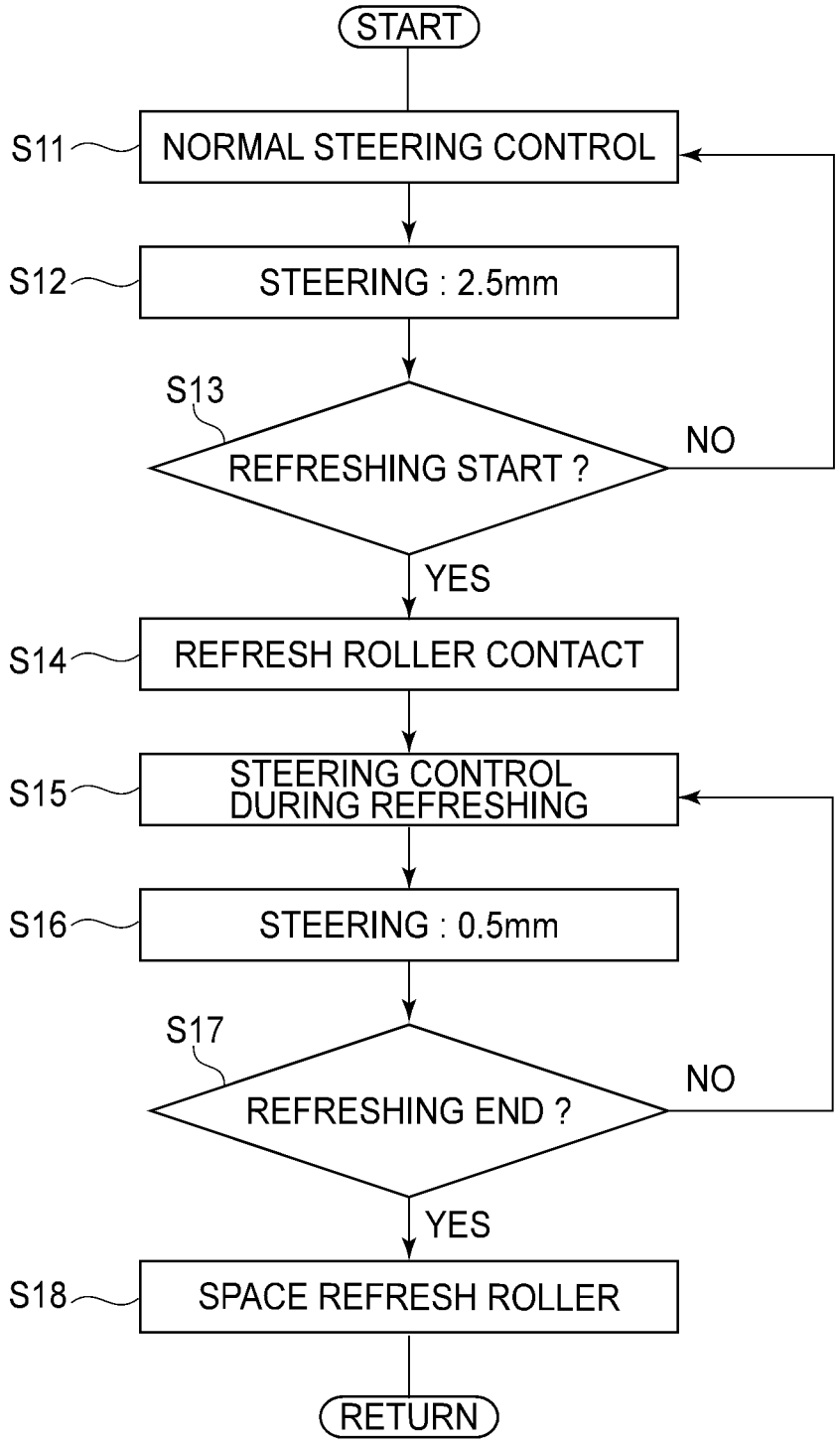
FIG. 4 is a flow chart of an operation in a refreshing mode in Embodiment 1.

FIG. 4 is a flow chart of the operation in the refreshing mode in Embodiment 1. As shown in FIG. 4 with reference to FIG. 2, in Embodiment 1, a steering controller 64, which is an example of a control means, sets, in the operation in the refreshing mode, a maximum inclination angle of the steering roller 52 at a value smaller than that during image formation, thus inclining the steering roller 52 in an inclination angle range narrower than that during the image formation.

In the operations not only during the image formation, but also in the refreshing mode, the fixing belt 51 is subjected to steering control of a both-end reverse type. The both-end reverse type control is a steering type in which the fixing belt 51 is subjected to unlimited reciprocating motion in the widthwise direction by inclining the steering roller 52 by a predetermined angle every time when the fixing belt 51 reaches movable widthwise end portions.

For example, when the fixing belt 51 reaches the front side end portion position, the steering roller 52 is inclined in a direction opposite from the previous direction with a predetermined angle. The fixing belt 51 is located at the front side and therefore the front side of the steering roller 52 is moved upward.

As a result, the fixing belt 51 starts movement toward the rear side. Then, when the fixing belt 51 reaches the rear side end portion, the front side of the fixing belt 51 is moved downward. As a result, the fixing belt 51 starts movement toward the front side. By repetition of these operations, the fixing belt 51 is subjected to the unlimited reciprocating motion.

In the both-end reverse type, the fixing belt 51 is largely moved in the longitudinal direction and thus the position where the edge of the recording material P (paper edge) passes through the fixing nip with respect to the widthwise direction of the fixing belt 51 changes for every recording material P, and therefore the both-end reverse type is advantageous in terms of durability of the fixing belt 51.

In Embodiment 1, in the steering control during refreshing of the fixing belt 51, the amount of displacement of the steering roller 52 is made smaller than that during image formation. Specifically, during the image formation, the steering roller 52 is controlled with the displacement amount of ±2.5 mm in the vertical direction with respect to the home position but on the other hand, during the refreshing, is controlled with the displacement amount of ±0.5 mm.

As shown in FIG. 4, in steering control (S11) during the image formation (NO of S13), the displacement amount of the steering roller 52 is 2.5 mm (S12). Every time when the fixing belt 51 reaches each of widthwise ends to which the fixing belt 51 is movable, the steering roller 52 is moved to the position of 2.5 mm upward and downward from the home position, thus subjecting the fixing belt 51 to the unlimited reciprocating motion.

The steering controller 64 causes, when it receives a refreshing start job (YES of S13), at first, the refreshing roller 63 to contact the fixing belt 51 (S14). Then, the sequence goes to the steering control during the refreshing (S15), and the steering controller 64 sets the displacement amount of the steering roller 63 at 0.5 mm (S16).

As a result, the steering roller 63 is moved from the current position of 2.5 mm from the home position to the position of 0.5 mm from the home position with respect to the same direction. If the fixing belt 51 reaches the end of a reciprocating movement range, the front side of the steering roller 52 is moved to the position of 0.5 mm from the home position at an opposite side with respect to the home position.

When the refreshing of the fixing belt 51 is ended (S17), first, the refreshing roller 63 is spaced (S18). Then, in order to return the sequence to the steering control during the image formation (S11), the steering roller 52 is moved from the current position of 0.5 mm from the home position to the position of 2.5 mm from the home position with respect to the same direction.

Thereafter (NO of S13), every time when the fixing belt 51 reaches each of the ends to which the fixing belt 51 is movable, the shaft of the steering roller 52 is moved (upward and downward) to the positions of 2.5 mm from the home position (S11).

When the displacement amount of the steering roller 52 is still large during the refreshing, the locus of the fixing belt 51 is largely different with respect to the height direction between the front side and the rear side. As a result, with respect to the widthwise direction of the fixing belt 51, the contact area between the fixing belt 51 and the refreshing roller 63 largely differs between the front side and the rear side.

In Embodiment 1, decreasing the displacement amount of the steering roller 52 during the refreshing, causes the difference in locus of the fixing belt 51 to become small between the front side and the rear side. As a result, with respect to the widthwise direction of the fixing belt 51, the difference in contact area between the fixing belt 51 and the refreshing roller 63 can be made small between the front side and the rear side.

The difference in contact area is small and thus substantially the same abrasion mark can be provided over the entire surface region of the fixing roller 53, and therefore when a whole-surface image (solid image) with a maximum gradation level is formed on coated paper, the occurrence of differences in glossiness and color tint with respect to the sheet widthwise direction can be prevented.

Further, there are variations in peripheral length of the fixing belt 51 and the diameter of the rotatable supporting member. Further, when a temperature distribution is generated with respect to the widthwise direction of the fixing belt 51 due to a variation in heat generating distribution of the heater and due to the sheet passing and the like, a difference in peripheral length due to thermal expansion is generated with respect to the widthwise direction of the fixing belt 51 in some cases. For these reasons, the fixing belt 51 can be liable to move to the front side or the rear side.

If the displacement amount of the steering roller 52 is made small at the time of the steering control during the image formation, a force for reversing the lateral shift movement of the fixing belt 51 is weakened and therefore the steering control cannot be effected in some cases.

However, the refreshing roller 63 has a large friction resistance and when it contacts the fixing belt 51, the lateral shift speed of the fixing belt 51 with respect to the widthwise direction of the fixing belt 51 becomes slow. Further, the time required for the refreshing is normally 15-60 sec, which is a short time.

Therefore, in a limited state such as the refreshing of the fixing belt 51, the displacement amount of the steering roller 52 in the steering control can be made small. This is because even when the force for reversing the lateral shift movement of the fixing belt 51 is weakened, the movement speed of the fixing belt 51 in the widthwise direction is slow and the required time is also short, and thus the overshoot distance is short to result in no problem.

According to the control in Embodiment 1, in the image heating apparatus using the fixing belt 51, the paper edge abrasion mark can be prevented and also an output image with a high degree of uniformity in glossiness can be obtained after the refreshing.

Embodiment 2

Figure 5:
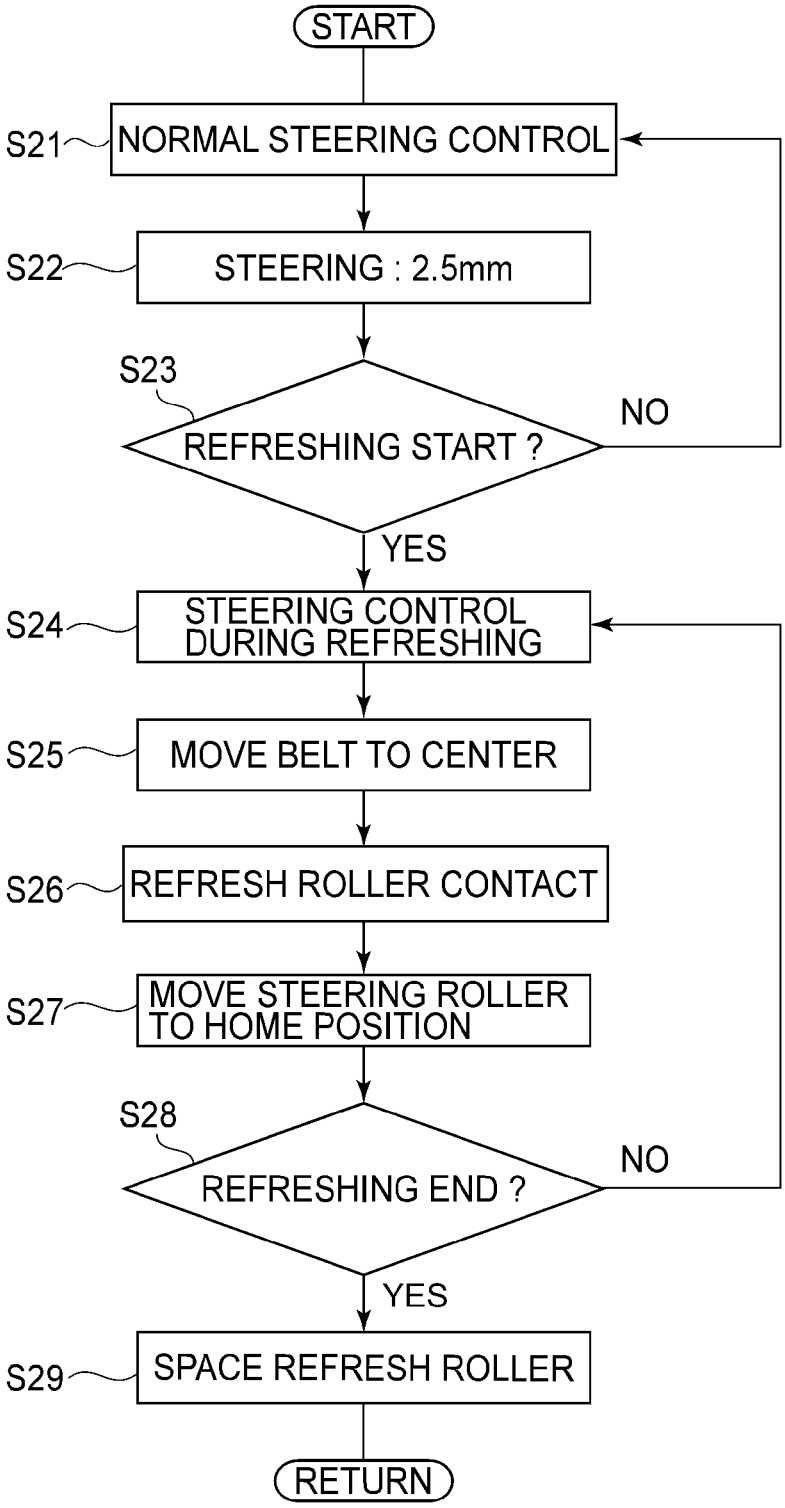
FIG. 5 is a flow chart of the operation in the refreshing mode in Embodiment 2.

FIG. 5 is a flow chart of the operation in the refreshing mode in Embodiment 2. In Embodiment 2, a steering controller 64 fixes, in the operation in the refreshing mode, a maximum inclination angle of the steering roller 52 in a state in which the lateral shift speed is made smaller than that during the image formation. However, when the fixing belt 51 reaches a predetermined lateral shift position in the operation in the refreshing mode, in order to avoid complete lateral shift, the refreshing roller 63 is spaced from the fixing belt 51 and then the lateral shift control by the steering roller 52 is effected. Further, after the fixing belt 51 is moved toward the center side in the widthwise direction, the refreshing roller 63 is contacted to the fixing belt 51 again.

Specifically, in the steering control during refreshing of the fixing belt 51, the fixing belt 51 is positioned at the widthwise center to stop the lateral shift movement and then the inclination angle of the steering roller 52 is kept at 0 degrees. After awaiting the movement of the fixing belt 51 to the center position in the widthwise direction, the position (height) of the steering roller 52 at the front side is moved to the home position, and during the refreshing of the fixing belt 51, the position of the steering roller 52 is fixed at the home position.

As shown in FIG. 5, in steering control (S21) during the image formation (NO of S23), the displacement amount of the steering roller 52 is 2.5 mm (S22). Every time when the fixing belt 51 reaches each of widthwise ends to which the fixing belt 51 is movable, the steering roller 52 is moved to the position of 2.5 mm upward and downward from the home position, thus subjecting the fixing belt 51 to the unlimited reciprocating motion.

The steering controller 64 causes, when it receives a refreshing start job (YES of S23), at first, the performing of steering control during refreshing (S24) and the fixing belt 51 is moved to the center position in the widthwise direction (S25). The movement position of the steering roller 52 at the front side is reversed and thus the lateral shift movement direction of the fixing belt 51 is reversed. Thereafter, after awaiting a lapse of a time corresponding to ½ of a normal one-side movement time, an amount of the movement of the steering roller 52 at the front side is set at 0 mm (home position).

Incidentally, the height position of the steering roller 52 at the front side is controlled on the basis of an output of the belt lateral shift position sensor 59 capable of continuously detecting the lateral shift position of the fixing belt 51 with respect to the widthwise direction, so that the lateral shift movement of the fixing belt 51 may also be converged at the widthwise center position.

Alternatively, in the steering control using the movement amount of ±2.5 mm, easiness of the lateral shift movement of the fixing belt 51 may also be discriminated by comparing a movement time of the fixing belt 51 from the front side to the rear side with a movement time of the fixing belt 51 from the rear side to the front side. On the basis of a discrimination result of the easiness of the lateral shift movement the height position of the steering roller 52 at the front side is set, so that the lateral shift movement speed of the fixing belt 51 during the refreshing can be lowered.

In either case, the fixing belt 51 is positioned at the widthwise center to substantially stop the reciprocating motion and in a state in which the inclination angle of the steering roller 52 is fixed at substantially 0 degrees, the refreshing of the fixing belt 51 by the refreshing roller 63 is executed.

When the fixing belt 51 is moved to the neighborhood of the center (S25), the refreshing roller 63 is contacted to the fixing belt 51 (S26). Then, the height position of the steering roller 52 at the front side is moved to the home position, and the steering roller 52 is fixed at the position until the refreshing is ended (S27).

When the refreshing is ended (YES of S28), first, the refreshing roller 63 is spaced (S29). Thereafter, the sequence is returned to the normal steering control (S21).

In Embodiment 2, the position of the shaft of the steering roller 52 is located at the home position during the refreshing of the fixing belt 51 and therefore the height position of the locus of the fixing belt 51 is the same between the front side and the rear side. As a result, with respect to the widthwise direction of the fixing belt 51, a difference in contact area between the fixing belt 51 and the refreshing roller 63 can be eliminated between the front side and the rear side.

There is no difference in contact area and thus the same abrasion mark can be provided over the entire surface region of the fixing belt 51, and therefore when a whole-surface image with a maximum density is formed on, e.g., coated paper, the differences in glossiness and color tint are not generated on the image surface.

Here, when the height position of the steering roller 52 at the front side is moved to the home position, shafts of the steering roller 52, the fixing roller 53 and the pushing roller 62 are parallel to each other and therefore naturally, the fixing belt 51 will not be moved to the front side and the rear side. However, in actuality, the fixing belt 51 can cause its lateral shift movement in either of the directions toward the front side and the rear side.

In this respect, in Embodiment 2, at the time when the fixing belt 51 is moved to the neighborhood of the center, the refreshing roller 63 having the large friction resistance contacts the fixing belt 51 and therefore even if the lateral shift movement speed remains, the lateral shift movement speed of the fixing belt 51 in the widthwise direction becomes slow. Further, the time required for the refreshing is short and therefore the movement distance is very short, and thus the movement of the fixing belt 51 from the neighborhood of the center to the end portion is rare.

However, during the refreshing of the fixing belt 51, there is also a possibility that the fixing belt 51 reaches its widthwise limit position. In this case, the steering controller 64 spaces the refreshing roller 63 and interrupts the refreshing and at the same time resumes the normal steering control of ±2.5 mm. Then, the fixing belt 51 is moved to the center position again and in the state in which the front side position of the steering roller 52 is fixed at the home position, remaining refreshing is resumed.

Embodiment 3

Figure 6:
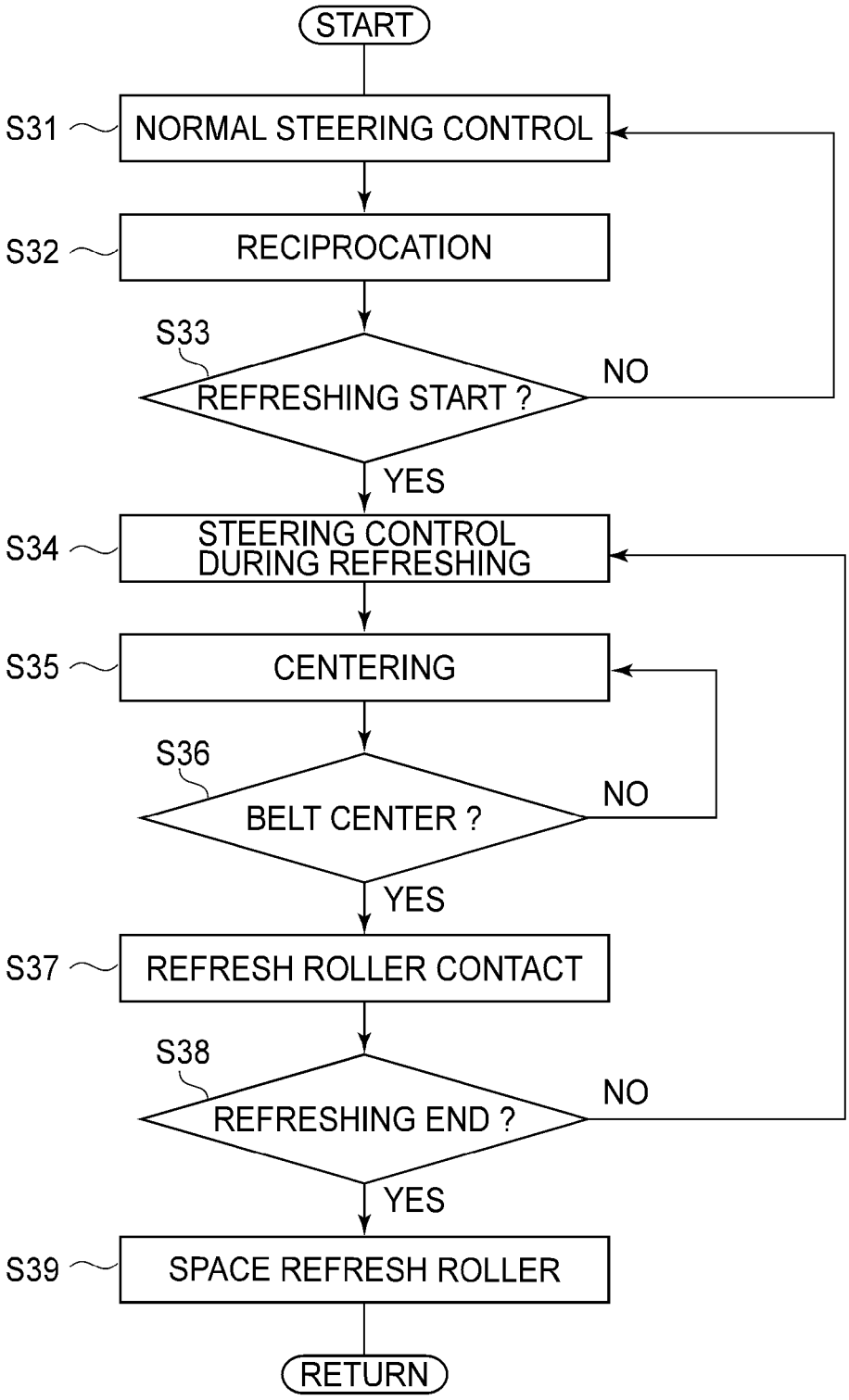
FIG. 6 is a flow chart of the operation in the refreshing mode in Embodiment 3.
Figure 7:
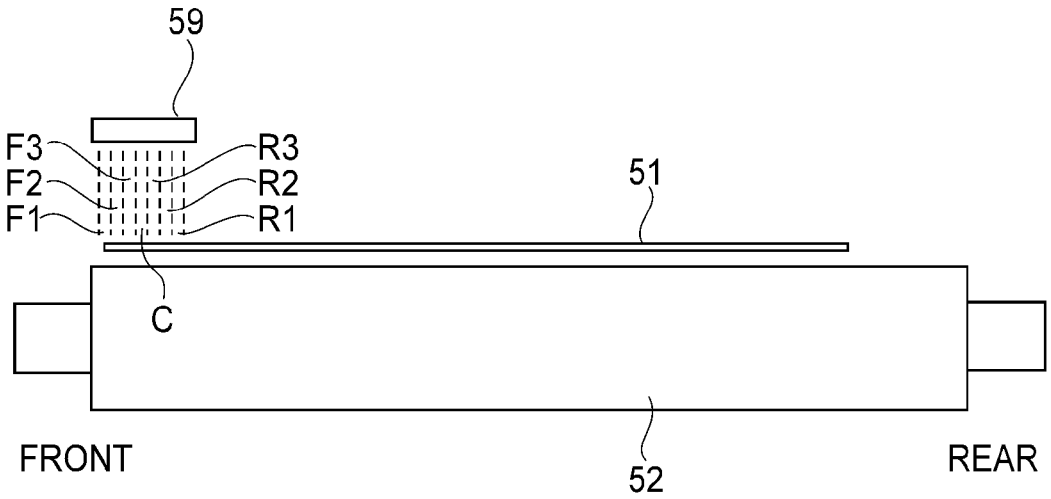
FIG. 7 is an illustration of a lateral shift position of a fixing belt in steering control.

FIG. 6 is a flow chart of the operation in the refreshing mode in Embodiment 3. FIG. 7 is an illustration of the lateral shift position of the fixing belt in the steering control. In Embodiment 3, the steering controller 64 effects, during the image formation, the control of the both-end reciprocation type mechanism in which the inclination angle of the steering roller 52 is reversed (switched) between two values to subject the fixing belt 51 to the reciprocation movement in the widthwise direction between predetermined two positions. However, in the operation in the refreshing mode, the steering controller 64 effects the control of the center convergence type mechanism in which the inclination angle of the steering roller 52 is made smaller as the fixing belt 51 approaches the widthwise center.

Specifically, in the steering control during the image formation, similarly as in Embodiments 1 and 2, the both-end reciprocation type method is employed. However, during the refreshing of the fixing belt 51, the type of method is switched to the center convergence type in which the inclination amount of the shaft of the steering roller 52 is made larger as the fixing belt 51 is more spaced from the center.

As shown in FIG. 6, in steering control of the fixing belt 51 (S31) during the image formation (NO of S33), the displacement amount of the front side height of the steering roller 52 is 2.5 mm. Every time when the fixing belt 51 reaches each of widthwise ends to which the fixing belt 51 is movable, the steering roller 52 is moved to the position of 2.5 mm upward and downward from the home position, thus subjecting the fixing belt 51 to the unlimited reciprocating motion (S32).

As shown in FIG. 7, the widthwise position of the fixing belt 51 is divided into 7 sections depending on the output of the belt lateral shift position sensor 59. The 7 sections are R1 at the rearmost position, R2 at a second position from the rearmost position, R3 at a third position from the rearmost position, C at the center position, F1 at the frontmost position, F2 at a second position from the frontmost position and F3 at a third position from the frontmost position.

(1) In the case where the fixing belt 51 is detected at the rearmost position R1, the front side of the steering roller 52 is moved downward by 3.0 mm.

(2) In the case where the fixing belt 51 is detected at the second position R2 from the rearmost position, the front side of the steering roller 52 is moved downward by 2.0 mm.

(3) In the case where the fixing belt 51 is detected at the third position R3 from the rearmost position, the front side of the steering roller 52 is moved downward by 0.5 mm.

(4) In the case where the fixing belt 51 is detected at the center position C, the front side of the steering roller 52 is moved to the home position.

(5) In the case where the fixing belt 51 is detected at the frontmost position F1, the front side of the steering roller 52 is moved upward by 3.0 mm.

(6) In the case where the fixing belt 51 is detected at the second position F2 from the frontmost position, the front side of the steering roller 52 is moved upward by 2.0 mm.

(7) In the case where the fixing belt 51 is detected at the third position F3 from the frontmost position, the front side of the steering roller 52 is moved upward by 0.5 mm.

By effecting such control, during the image formation, the fixing belt 51 is successively detected in the order of, e.g., F1, R1, F2, R2, F3 and R3 and converges to the center position C, where the lateral shift movement is stopped. Further, even when the fixing belt 51 is subjected to some disturbance and is deviated from the center, the force for moving the fixing belt 51 toward the center becomes stronger with an increasing distance from the center toward the widthwise ends and therefore a phenomenon that the fixing belt 51 is moved to the end portions and thus is completely laterally shifted (to the outside of the roller) does not occur.

The steering controller 64, after the both-end reciprocation (S32), when it receives the refreshing start job (YES of S33) switches from the both-end reciprocation type control (S32) to steering control during refreshing (S34) and the center convergence type control (S35).

After the switch to the center convergence type control, when the fixing belt 51 is moved to the center position C (YES of S36), the refreshing roller 63 is contacted to the fixing belt 51 (S37) and the refreshing of the fixing belt 51 is executed. When the refreshing is ended (YES OF S38), first, the refreshing roller 63 is spaced from the fixing belt 51 (S39). Thereafter, the control type is returned to the both-end reciprocation type for the normal steering control (S32).

In Embodiment 3, the steering control of the both-end reciprocation type is effected during the normal operation and therefore the fixing belt 51 is largely moved in the widthwise direction to change the position of the paper edges by sheet passing, thus being advantageous in terms of durability of the fixing belt 51.

Then, during the refreshing, the steering control of the center convergence type is effected and therefore the fixing belt 51 is located in a place where the inclination amount of the steering roller 52 in the neighborhood of the center, thus resulting in a small difference in height of the locus of the fixing belt 51 between the front side and the rear side.

As a result, with respect to the widthwise direction of the fixing belt 51, the difference in contact area between the fixing belt 51 and the refreshing roller 63 can also be made small between the front side and the rear side. The contact area difference is small and thus the substantially same abrasion mark can be provided on the entire surface region of the fixing roller 53 by the refreshing roller 63. For this reason, when a full-color image with a high density is formed on the coated paper, the occurrences of differences in glossiness and color tint can be prevented.

Further, during the refreshing, the inclination angle of the shaft of the steering roller 52 becomes larger as the fixing belt 51 is spaced to a greater extent from the center position and the force for moving the fixing belt 51 toward the center becomes strong and thus a phenomenon that the end portion of the fixing belt 51 exceeds the limit position to which the fixing belt 51 is movable and the end portion of the fixing belt 51 is broken does not occur.

In this embodiment, the refreshing roller 63 is disposed between the steering roller 52 and the fixing roller 53 but may also be disposed at a position where the refreshing roller 63 urges the steering roller 52 or the fixing roller 53.

As described above, by the present invention, the rotatable steering member is controlled at the inclination angle smaller than that during the image heating in the operation in the refreshing mode, so that a degree of a variation in contact state of the belt member with the inclination of the rotatable steering member with respect to the longitudinal direction of the slidable member is reduced. As a result, the difference in contact state of the slidable member to the belt member with respect to the longitudinal direction is alleviated, so that it is possible to reduce a degree of the variation in surface state of the belt member adjusted by the operation in the refreshing mode.

While the invention has been described with reference to the structures disclosed herein, it is not confined to the details set forth and this application is intended to cover such modifications or changes as may come within the purpose of the improvements or the scope of the following claims.

This application claims priority from Japanese Patent Application No. 071779/2011 filed Mar. 29, 2011, which is hereby incorporated by reference.

What is claimed is:

1. An image heating apparatus comprising:

a belt member configured to heat in a nip an image formed on a recording material;

a rotatable steering member configured to stretch said belt member and to control a position of said belt member with respect to a widthwise direction thereof by inclination of said rotatable steering member;

a slidable member provided so as to be movable toward and away from a surface of said belt member;

contact-and-separation means for moving said slidable member toward and away from said belt member;

a slidable member configured to contact said belt member and to slide on the surface of said belt member in a sliding mode; and control means for controlling the maximum inclination angle of said rotatable steering member during execution of an operation in the sliding mode so that the maximum inclination angle is set at a value smaller than that during image formation.

2. An image heating apparatus according to claim 1, wherein an inclinable range of said rotatable steering member during the execution of the operation in the sliding mode is set so as to be narrower than that during the image formation.

3. An image heating apparatus according to claim 1, wherein said control means fixes an inclination angle of said rotatable steering member in a state in which a lateral shift speed of said belt member in the operation in the sliding mode is made smaller than that during the image formation.

4. An image heating apparatus according to claim 1, wherein when said belt member reaches a predetermined position during the execution of the operation in the sliding mode, said control means moves said slidable member away from said belt member, effects lateral shift control by said rotatable steering member, moves said belt member toward a center with respect to the widthwise direction, and then causes said slidable member to contact said belt member.

5. An image heating apparatus according to claim 1, further comprising a fixing member configured to stretch said belt member and to form the nip, wherein said slidable member contacts a belt surface stretched by said rotatable steering member and said fixing member.

6. An image heating apparatus according to claim 5, wherein said slidable member urges either one of said rotatable steering member and said fixing member via said belt member.

7. An image heating apparatus comprising:

a belt member configured to heat an image formed on a recording material;

a rotatable steering member configured to stretch said belt member and to control a position of said belt member with respect to a widthwise direction thereof by inclination of said rotatable steering member;

a slidable member provided so as to be movable toward and away from a surface of said belt member;

contact-and-separation means for moving said slidable member toward and away from said belt member;

an execution portion configured to execute an operation in a sliding mode in which said slidable member is contacted to said belt member and is slid on the surface of said belt member; and control means for controlling the inclination of said rotatable steering member during execution of the operation in the sliding mode so that the position of said belt member with respect to the widthwise direction thereof is maintained at a predetermined position.

8. An image heating apparatus according to claim 7, wherein said control means controls the inclination of said rotatable steering member so that said belt member moves within a predetermined range with respect to the widthwise direction during the image formation.

9. An image heating apparatus according to claim 8, wherein said slidable member urges either one of said rotatable steering member and said fixing member via said belt member.

10. An image heating apparatus according to claim 7, further comprising a fixing member configured to stretch said belt member and to form a nip, wherein said slidable member contacts a belt surface stretched by said rotatable steering member and said fixing member.

* * * * *